US010992014B2

(12) United States Patent
Ohata et al.

(10) Patent No.: US 10,992,014 B2
(45) Date of Patent: Apr. 27, 2021

(54) NONRECIPROCAL CIRCUIT ELEMENT AND COMMUNICATION APPARATUS USING THE SAME

(71) Applicant: TDK Corporation, Tokyo (JP)

(72) Inventors: Hidenori Ohata, Tokyo (JP); Yoshinori Matsumaru, Tokyo (JP)

(73) Assignee: TDK CORPORATION, Tokyo (JP)

( * ) Notice: Subject to any disclaimer, the term of this patent is extended or adjusted under 35 U.S.C. 154(b) by 30 days.

(21) Appl. No.: 16/436,105

(22) Filed: Jun. 10, 2019

(65) Prior Publication Data

US 2019/0386368 A1 Dec. 19, 2019

(30) Foreign Application Priority Data

Jun. 18, 2018 (JP) ..... JP2018-115296

(51) Int. Cl.

| | |
|---|---|
| ***H01P 1/387*** | (2006.01) |
| ***H01P 1/38*** | (2006.01) |
| ***H01P 1/36*** | (2006.01) |
| ***H01P 1/218*** | (2006.01) |
| ***H01P 1/208*** | (2006.01) |

(52) U.S. Cl.

CPC ..... *H01P 1/38* (2013.01); *H01P 1/2084* (2013.01); *H01P 1/218* (2013.01); *H01P 1/36* (2013.01); *H01P 1/387* (2013.01)

(58) Field of Classification Search

CPC .. H01P 1/38; H01P 1/387; H01P 1/383; H01P 1/36; H01P 1/32

USPC ..... 333/1.1, 24.2

See application file for complete search history.

(56) References Cited

U.S. PATENT DOCUMENTS

| | | | | |
|---|---|---|---|---|
| 6,507,249 | B1 * | 1/2003 | Schloemann | H01P 1/32 333/1.1 |
| 6,597,563 | B2 * | 7/2003 | Matsuta | H01P 1/387 333/1.1 |
| 2003/0128078 | A1 * | 7/2003 | Koseki | H01P 1/387 333/1.1 |
| 2013/0321090 | A1 | 12/2013 | Cruickshank et al. | |
| 2018/0138572 | A1 | 5/2018 | Ohata et al. | |

FOREIGN PATENT DOCUMENTS

| | | | |
|---|---|---|---|
| JP | 5231555 | B2 | 11/2017 |
| JP | 2018-082229 | A | 5/2018 |

* cited by examiner

*Primary Examiner* — Stephen E. Jones
(74) *Attorney, Agent, or Firm* — McDermott Will & Emery LLP

(57) ABSTRACT

Disclosed herein is a nonreciprocal circuit element that includes a permanent magnet, a magnetic material having an insulating property, a magnetic rotator sandwiched between the permanent magnet and the magnetic material, and an external terminal. The magnetic rotator includes a center conductor connected to the external terminal, and first and second ferrite cores sandwiching the center conductor. The external terminal covers a side surface of the magnetic material without covering a side surface of the permanent magnet.

16 Claims, 11 Drawing Sheets

NONRECIPROCAL CIRCUIT ELEMENT AND COMMUNICATION APPARATUS USING THE SAME

BACKGROUND OF THE INVENTION

Field of the Invention

The present invention relates to a nonreciprocal circuit element and a communication apparatus using the nonreciprocal circuit element and, more particularly, to a nonreciprocal circuit element such as an isolator or a circulator suitably used in microwave or millimeter-wave frequency bands and a communication apparatus using such a nonreciprocal circuit element.

Description of Related Art

A nonreciprocal circuit element such as an isolator or a circulator is incorporated in, e.g., a mobile communication device like a mobile phone or a communication apparatus used in a base station. As described in Japanese Patent No. 6,231,555, a general nonreciprocal circuit element is constituted of a magnetic rotator having a center conductor and a pair of ferrite cores sandwiching the center conductor and a permanent magnet applying a magnetic field to the magnetic rotator.

Further, JP 2018-082229 A discloses a nonreciprocal circuit element capable of being obtained in large number at a time by cutting an aggregate substrate. The nonreciprocal circuit element disclosed in JP 2018-082229 A is mounted on a substrate in a laid-down state at 90° with respect to the lamination direction. This allows an external terminal to be disposed at a portion where a permanent magnet is absent, making it possible to prevent deterioration in characteristics due to crossing of the external terminal through the permanent magnet.

However, when the nonreciprocal circuit element is mounted on a substrate in a laid-down state at 90° with respect to the lamination direction, as in the invention of JP 2018-082229 A, the surface direction of a center conductor is perpendicular to the mounting direction, so that height dimension of a product becomes very large in a low frequency region (several GHz or less).

SUMMARY

It is therefore an object of the present invention to prevent deterioration in characteristics due to crossing of the external terminal through the permanent magnet in a nonreciprocal circuit element capable of being mounted in such a way that the surface direction of the center conductor is parallel to the mounting direction. Another object of the present invention is to provide a communication apparatus using the above nonreciprocal circuit element.

A nonreciprocal circuit element according to the present invention includes a permanent magnet, a magnetic material having an insulating property, a magnetic rotator sandwiched between the permanent magnet and the magnetic material, and an external terminal. The magnetic rotator includes a center conductor connected to the external terminal, and first and second ferrite cores sandwiching the center conductor. The external terminal covers the side surface of the magnetic material without covering the side surface of the permanent magnet.

Further, a communication apparatus according to the present invention includes the above nonreciprocal circuit element.

According to the present invention, the magnetic rotator is sandwiched between the permanent magnet and the magnetic material, the external terminal can be provided so as to cover the side surfaces of the magnetic material without covering the side surfaces of the permanent magnet. This can prevent degradation in high-frequency characteristics due to contact between the external terminal and the permanent magnet. In addition, the nonreciprocal circuit element can be mounted in such a manner that the surface direction of the center conductor is parallel to the mounting direction, so that the height dimension of a product is not increased even when the frequency band is low.

The nonreciprocal circuit element according to the present invention may further include a ground terminal and a first grounding conductor which is provided between the first ferrite core and the magnetic material and connected to the ground terminal. With this configuration, the first ferrite core and the magnetic material are electrically isolated from each other by the first grounding conductor provided between the first ferrite core and the magnetic material. This can prevent a change in electric characteristics due to the presence of the magnetic material.

The nonreciprocal circuit element according to the present invention may further include a second grounding conductor provided between the second ferrite core and the permanent magnet and connected to the ground terminal. With this configuration, the second ferrite core and the permanent magnet can be electrically isolated from each other.

In the present invention, the saturation magnetization of the magnetic material may be equal to or smaller than the saturation magnetizations of the first and second ferrite cores. This can reduce passage loss. In this case, the magnetic material may be made of the same material as those of the first and second ferrite cores. This can suppress increase in material cost.

The nonreciprocal circuit element according to the present invention may further include a first metal magnetic material provided between the second ferrite core and the permanent magnet. This can make the distribution of a magnetic field to be applied to the second ferrite core more uniform. In this case, the nonreciprocal circuit element according to the present invention may further include a second metal magnetic material provided on the side opposite to the first metal magnetic material with respect to the permanent magnet. This can further strengthen a magnetic field to be applied to the first ferrite core.

The nonreciprocal circuit element according to the present invention may further include another magnetic material having an insulating property which is provided between the second ferrite core and the permanent magnet. This can make the distribution of the magnetic field to be applied to the second ferrite core more uniform. In this case, the nonreciprocal circuit element according to the present invention may further include a metal magnetic material provided on the side opposite to the another magnetic material with respect to the permanent magnet. This can further strengthen the magnetic field to be applied to the first ferrite core.

As described above, according to the present invention, there can be provided a nonreciprocal circuit element capable of preventing degradation in high-frequency characteristics due to contact between the external terminal and the permanent magnet and a communication apparatus using the nonreciprocal circuit element. In addition, the nonreciprocal circuit element can be mounted in such away that the surface direction of the center conductor is parallel to the mounting direction, so that the height dimension of a product is not increased even when the frequency band is low.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Preferred embodiments of the present invention will be explained below in detail with reference to the accompanying drawings.

First Embodiment

Figure 1:
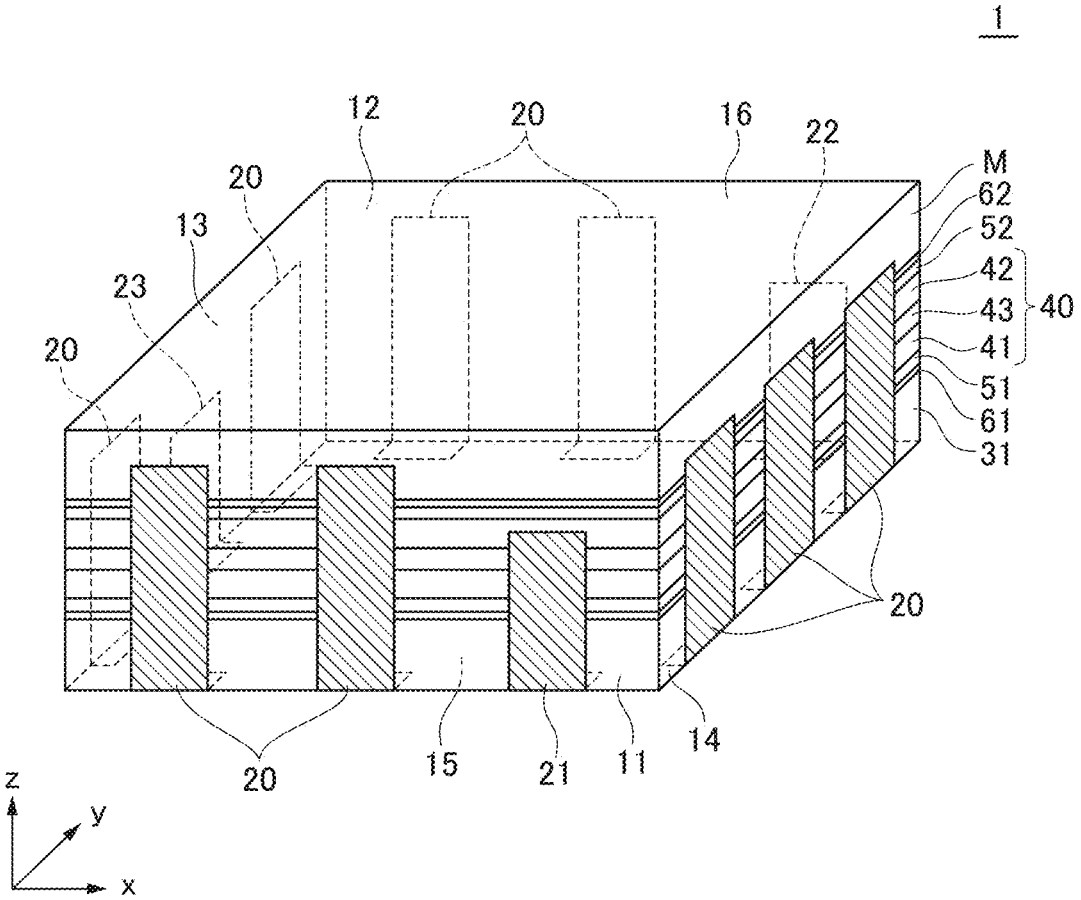
FIG. 1 is a schematic perspective view illustrating the configuration of a nonreciprocal circuit element according to a first embodiment of the present invention.
Figure 2:
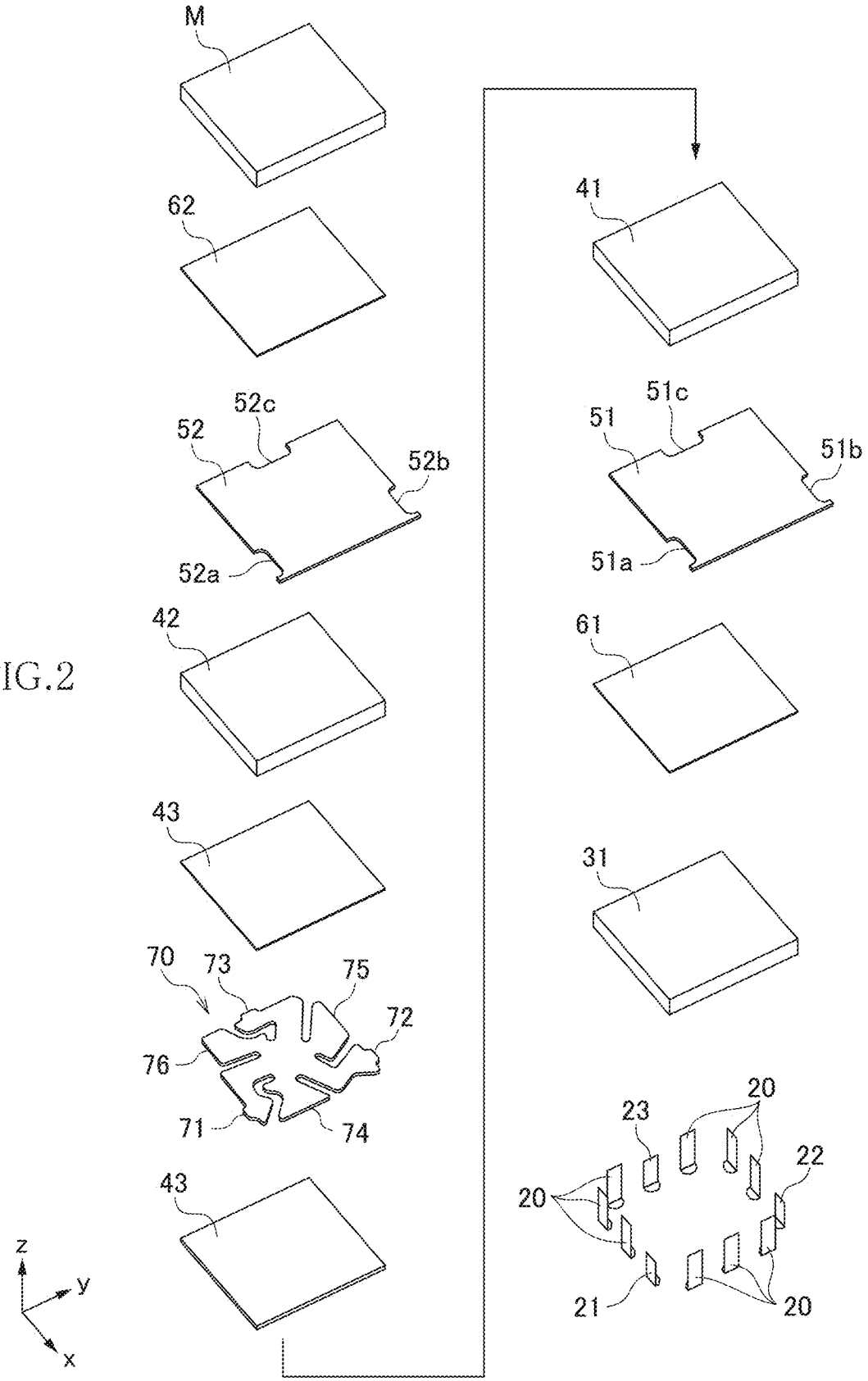
FIG. 2 is a schematic exploded perspective view of the nonreciprocal circuit element shown in FIG. 1.

FIG. 1 is a schematic perspective view illustrating the configuration of a nonreciprocal circuit element 1 according to the first embodiment of the present invention. FIG. 2 is a schematic exploded perspective view of the nonreciprocal circuit element 1.

The nonreciprocal circuit element 1 illustrated in FIGS. 1 and 2 is a distributed-constant-type nonreciprocal circuit element. The nonreciprocal circuit element 1 is incorporated in, e.g., a mobile communication device like a mobile phone or a communication apparatus used in a base station and used as an isolator or a circulator. Although not particularly limited, the nonreciprocal circuit element 1 according to the present embodiment is suitably used for a communication apparatus used in a base station.

As illustrated in FIGS. 1 and 2, the nonreciprocal circuit element 1 according to the present embodiment is a surface-mount-type chip component having a substantially rectangular parallelepiped shape and has first and second side surfaces 11 and 12 (xz plane), third and fourth side surfaces 13 and 14 (yz plane), and a mounting surface 15 (xy plane) and a top surface 16 (xy plane). The first side surface 11 is provided with a first external terminal 21, the second side surface 12 is provided with a second external terminal 22, and the third side surface 13 is provided with a third external terminal 23. Further, the first to fourth side surfaces 11 to 14 are each provided with a plurality of ground terminals 20. A portion of each of the external terminals 21 to 23 and ground terminals 20 is tucked under the mounting surface 15.

The three external terminals 21 to 23 are connected to their corresponding signal lines when the nonreciprocal circuit element 1 according to the present embodiment is used as a circulator. On the other hand, when the nonreciprocal circuit element 1 according to the present embodiment is used as an isolator, for example, the external terminals 21 and 22 are connected to their corresponding signal lines, and the external terminal 23 is grounded through a terminal resistor. Further, even when the external terminal 21 or 22 is grounded through a terminal resistor, the nonreciprocal circuit element 1 according to the present embodiment can be used as an isolator. A ground potential is given to the plurality of ground terminals 20 in common.

Further, the nonreciprocal circuit element 1 includes a permanent magnet M, a magnetic material 31 having an insulating property, and a magnetic rotator 40 sandwiched between the permanent magnet M and the magnetic material 31 in the z-direction which is the lamination direction. The permanent magnet M may be a ferrite magnet having an insulating property or a rare earth magnet having conductivity. As the material for the magnetic material 31 having an insulating property, ferrite is preferably used, and high-frequency ferrite having a small dielectric loss tangent (tan δ), such as yttrium/iron/garnet (YIG), is more preferably used.

The magnetic rotator 40 includes two ferrite cores 41 and 42 and a center conductor 70 sandwiched between the ferrite cores 41 and 42 in the z-direction. As the material for the ferrite cores 41 and 42, a soft magnetic material such as yttrium/iron/garnet (YIG) is preferably used. That is, the same magnetic material can be used for the ferrite core (41, 42) and magnetic material 31. However, the magnetic material for the ferrite core (41, 42) and the magnetic material 31 may not necessarily be the same, but the ferrite core and magnetic material 31 may be made of different magnetic materials. In this case, as a magnetic material constituting the magnetic material 31, a magnetic material having a saturation magnetization equal to or smaller than that of a magnetic material constituting the ferrite core (41, 42) is preferably used.

The planar shape of the center conductor 70 is as illustrated in FIG. 2, and the center conductor 70 has three ports 71 to 73 radially led from the center point thereof and branch conductors 74 to 76 for adjusting electric characteristics. The center conductor 70 and ferrite cores 41 and 42 adhere to each other through a dielectric 43 having adhesiveness. Although there is no particular restriction on the material for the dielectric 43, a material having substantially the same dielectric constant as those of the ferrite cores 41 and 42 is preferably used.

The tip end of the first port 71 led from the center conductor 70 is exposed to the first side surface 11 and is thus connected to the first external terminal 21. The tip end of the second port 72 led from the center conductor 70 is exposed to the second side surface 12 and is thus connected to the second external terminal 22. The tip end of the third port 73 led from the center conductor 70 is exposed to the third side surface 13 and is thus connected to the third external terminal 23.

The nonreciprocal circuit element 1 according to the present embodiment further has a grounding conductor 51 sandwiched between the magnetic material 31 and the magnetic rotator 40 in the z-direction and a grounding conductor 52 sandwiched between the permanent magnet M and the magnetic rotator 40 in the z-direction. Thus, the center conductor 70 is sandwiched between the two grounding conductors 51 and 52 and thus isolated from the magnetic material 31 and the permanent magnet M. The grounding conductor 51 has cuts 51*a* to 51*c* formed at portions respectively overlapping the external terminals 21 to 23, and the grounding conductor 52 has cuts 52*a* to 52*c* formed at portions respectively overlapping the external terminals 21 to 23, thereby preventing the grounding conductors 51 and 52 from interfering with the external terminals 21 to 23. The remaining parts of each of the grounding conductors 51 and 52 are exposed from the first to fourth side surfaces 11 to 14. Thus, the plurality of ground terminals 20 are each connected to both the grounding conductors 51 and 52.

In the present embodiment, the grounding conductor 51 is printed on the lower surface of the ferrite core 41, and the grounding conductor 52 is printed on the upper surface of the ferrite core 42. Thus, the grounding conductor 51 and the ferrite core 41 closely adhere to each other with substantially no gap, and the grounding conductor 52 and the ferrite core 42 closely adhere to each other with substantially no gap. The magnetic material 31 and the grounding conductor 51 adhere to each other through a dielectric 61 having adhesiveness, and the permanent magnet M and the grounding conductor 52 adhere to each other through a dielectric 62 having adhesiveness. The dielectrics 61 and 62 may be formed using the same material as the dielectric 43.

As described above, in the present embodiment, the magnetic rotator 40 is electrically isolated from the magnetic material 31 and the permanent magnet M by the grounding conductors 51 and 52, so that electric characteristics of the magnetic rotator 40 itself do not change even when, e.g., the thickness of the magnetic material 31 is changed.

In the present embodiment, the dielectric 43 is filled between the ferrite cores 41 and 42. Further, a material having substantially the same dielectric constant as the ferrite cores 41 and 42 is selected as the material for the dielectric 43. This allows electric characteristics almost as designed to be obtained even when a distortion or film thickness distribution is present in the center conductor 70.

As described above, in the nonreciprocal circuit element 1 according to the present embodiment, the permanent magnet M is disposed above the magnetic rotator 40, while below the magnetic rotator 40, the permanent magnet is not disposed but, instead, the magnetic material 31 having an insulating property is disposed. Thus, the external terminals 21 to 23 can be disposed so as to cover the side surfaces of the magnetic material 31 without covering the side surfaces of the permanent magnet M, thus making it possible to prevent degradation in high-frequency characteristics due to covering of the side surfaces of the permanent magnet M with the external terminals 21 to 23. In addition, the magnetic rotator 40 and the magnetic material 31 are electrically isolated from each other by the grounding conductor 51, so that the electric characteristics of the magnetic rotator 40 change even when the thickness of the magnetic material 31 is changed.

In the nonreciprocal circuit element 1 according to the present embodiment, the permanent magnet is not disposed below the magnetic rotator 40, so that, as compared to a case where the magnetic rotator 40 is sandwiched between two permanent magnets, a magnetic field to be applied to, particularly, the lower side ferrite core 41 tends to be weak, and the perpendicularity of the magnetic field tends to be deteriorated. To reduce this influence, it is preferable to ensure the thickness of the magnetic material 31 in the z-direction to a certain degree. This is because the larger the thickness of the magnetic material 31, the more magnetic flux flows in the magnetic material 31, thus strengthening the magnetic field to be applied to the ferrite core 41 and enhancing the magnetic field perpendicularity. Specifically, it is preferable to make the thickness of the magnetic material 31 equal to or larger than the thickness of the ferrite core 41.

Figure 3:
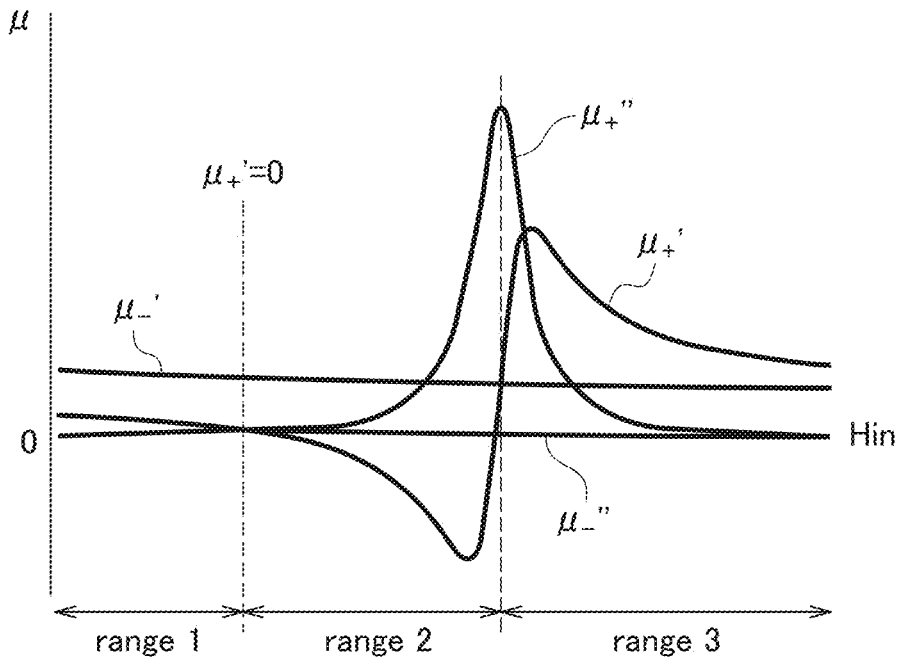
FIG. 3 is a graph illustrating the relationship between an internal DC magnetic field and a circularly polarized permeability.

However, even when the thickness of the magnetic material 31 is increased sufficiently, the magnetic field to be applied to the ferrite core 41 is weaker and the magnetic field perpendicularity is worse than a case where the permanent magnet is used in place of the magnetic material 31. However, when the magnetic rotator 40 is operated in a so-called Below Resonance region, nonreciprocal circuit operation can be sufficiently achieved even with a weak magnetic field. FIG. 3 is a graph illustrating the relationship between an internal DC magnetic field and a circularly polarized permeability, wherein when both $\mu_+'$ and $\mu_-'$ assume a positive value, the nonreciprocal circuit operation is achieved. That is, in the graph of FIG. 3, the nonreciprocal circuit operation can be achieved in a range 1 (Below Resonance) and a range 3 (Above Resonance). Many nonreciprocal circuit elements are operated in the range 3 (Above Resonance); however, when the nonreciprocal circuit element is operated in the range 1 (Below Resonance), the nonreciprocal circuit operation can be achieved with a comparatively weak magnetic field. Thus, the nonreciprocal circuit element 1 according to the present embodiment is preferably operated in the range 1 (Below Resonance). Further, in the Below Resonance region, when the frequency is determined, the upper limit of available saturation magnetization is determined. It is known that, generally, in a low magnetic field region like the Below Resonance, when ferrite is used at a low frequency, loss is abruptly increased, and the frequency f is given by the following expression.

$$f = \frac{\mu_0 \gamma}{2\pi}\left[H_a + \frac{M_s}{\mu_0}\right]$$

In the above expression, $H_a$ is an anisotropy field, $M_s$ is a saturation magnetization, $|\gamma|$ is $1.76\times10^3$ $[T^{-1}\cdot S^{-1}]$, and $\mu_0$ is vacuum permeability. The YIG has no anisotropy, so that when the above expression is solved for $M_s$ with $H_a$ approximated to 0, the following expression can be obtained.

$$M_s = \frac{2\pi}{\gamma} f$$

Thus, when the frequency is determined, the upper limit of the available saturation magnetization is determined. Generally, a saturation magnetization value close to the upper limit is selected for the ferrite core 41, so that when a material having a saturation magnetization value larger than the saturation magnetization value of the ferrite core 41 is used as the material for magnetic material 31, passage loss increases. Thus, as the material for the magnetic material 31, it is preferable to use a material having a saturation magnetization value equal to or smaller than the saturation magnetization value of the ferrite core 41.

Second Embodiment

Figure 4:
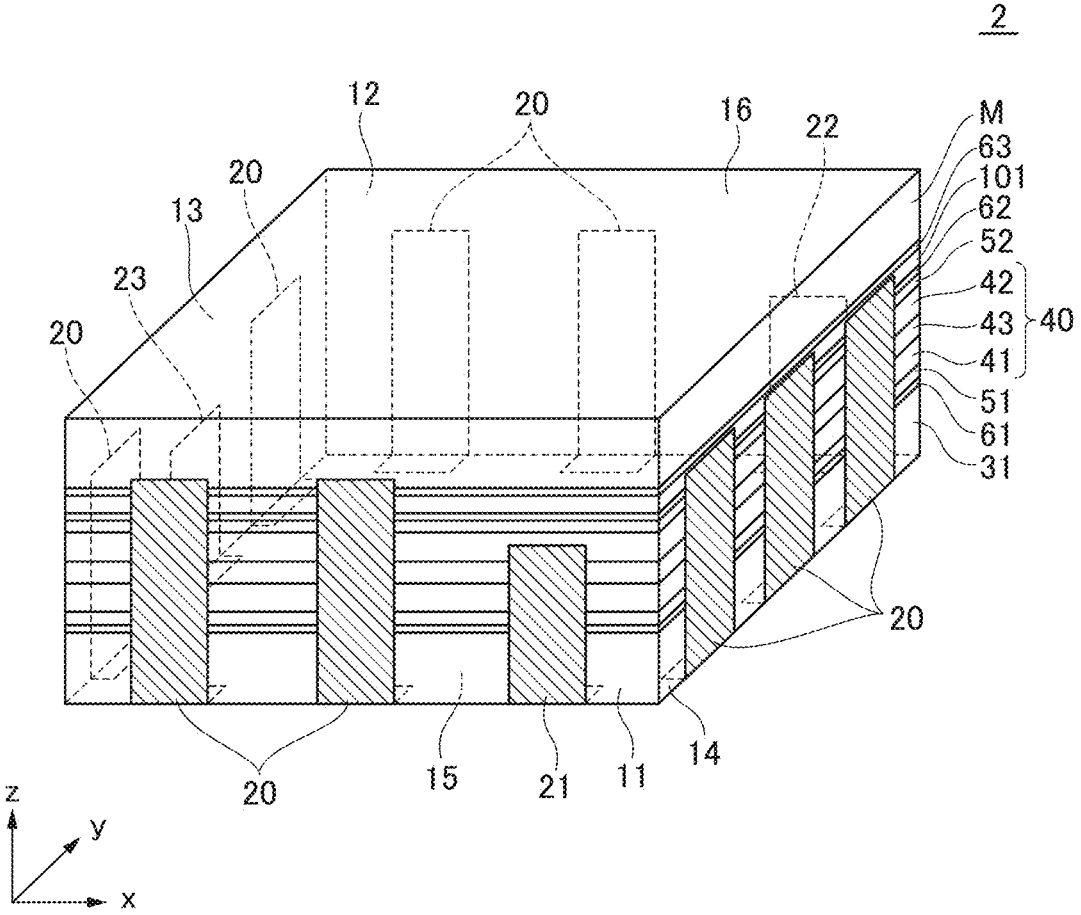
FIG. 4 is a schematic perspective view illustrating the configuration of a nonreciprocal circuit element according to a second embodiment of the present invention.

FIG. 4 is a schematic perspective view illustrating the configuration of a nonreciprocal circuit element 2 according to the second embodiment of the present invention.

As illustrated in FIG. 4, the nonreciprocal circuit element 2 according to the second embodiment differs from the nonreciprocal circuit element 1 according to the first embodiment in that a metal magnetic material 101 is inserted between the grounding conductor 52 and the permanent magnet M. The metal magnetic material 101 and the permanent magnet M adhere to each other through a dielectric 63 having adhesiveness. Other basic configurations are the same as those of the nonreciprocal circuit element 1 according to the first embodiment, so the same reference numerals are given to the same elements, and overlapping description will be omitted.

The metal magnetic material 101 is made of, e.g., iron (Fe) and plays a role of uniformizing magnetic flux to be given from the permanent magnet M to the ferrite core 42. That is, when the permanent magnet M is disposed on one side of the magnetic rotator 40, magnetic field distribution of, particularly, the ferrite core 42 adjacent to the permanent magnet M easily becomes nonuniform. To prevent this, the metal magnetic material 101 is provided, and the magnetic field to be applied to the ferrite core 42 is made more uniform, making it possible to prevent the magnetic field from being locally concentrated.

Third Embodiment

Figure 5:
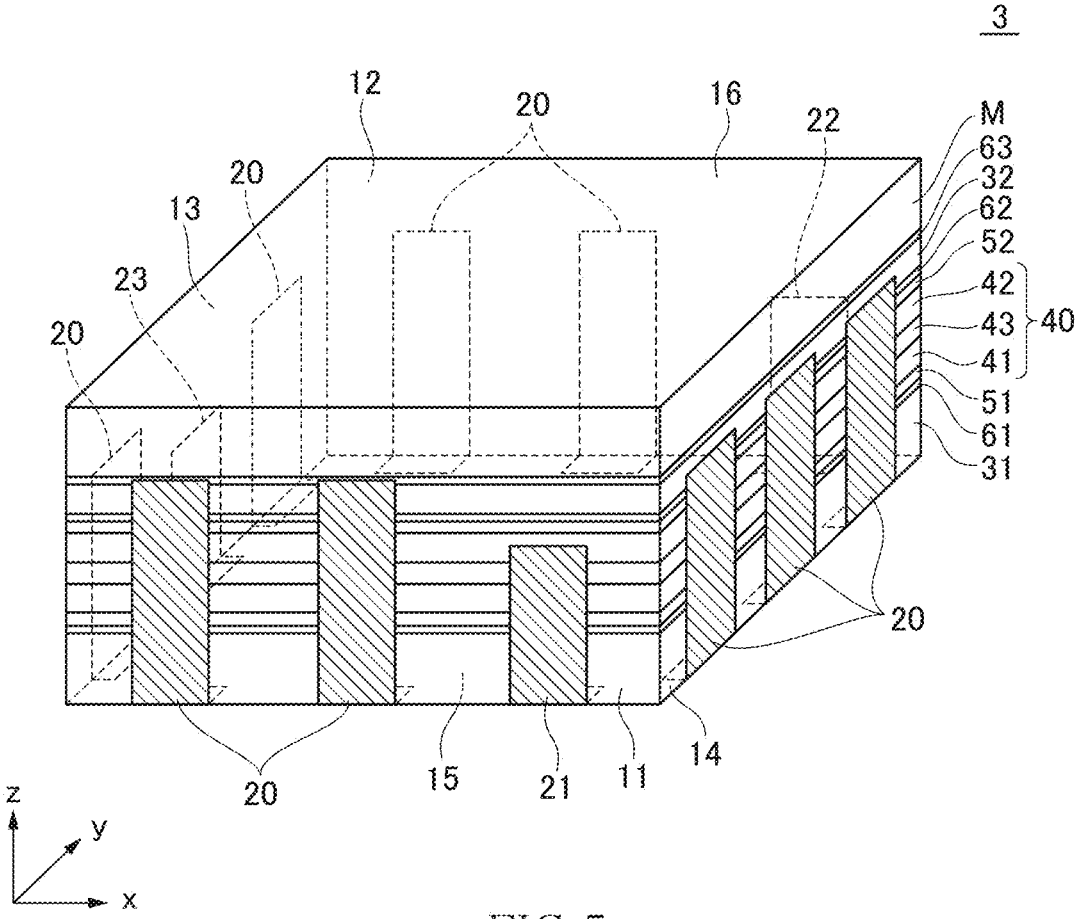
FIG. 5 is a schematic perspective view illustrating the configuration of a nonreciprocal circuit element according to a third embodiment of the present invention.

FIG. 5 is a schematic perspective view illustrating the configuration of a nonreciprocal circuit element 3 according to the third embodiment of the present invention.

As illustrated in FIG. 5, the nonreciprocal circuit element 3 according to the third embodiment differs from the nonreciprocal circuit element 1 according to the first embodiment in that another magnetic material 32 having an insulating property is inserted between the grounding conductor 52 and the permanent magnet M. The magnetic material 32 and the permanent magnet M adhere to each other through a dielectric 63 having adhesiveness. Other basic configurations are the same as those of the nonreciprocal circuit element 1 according to the first embodiment, so the same reference numerals are given to the same elements, and overlapping description will be omitted.

The magnetic material 32 is made of the same material (e.g., yttrium/iron/garnet (YIG)) as the magnetic material 31 and plays a role of uniformizing magnetic flux to be given from the permanent magnet M to the ferrite core 42 like the metal magnetic material 101 used in the second embodiment. The thickness of the magnetic material 32 in the z-direction may be smaller than the thickness of the magnetic material 31 in the z-direction. For example, the thickness of the magnetic material 32 may be made half the thickness of the magnetic material 31. This is because that it is not necessary to ensure a sufficient thickness for the magnetic material 32 due to the presence of the permanent magnet M in the vicinity thereof as compared to the magnetic material 31 distanced from the permanent magnet M.

Fourth Embodiment

Figure 6:
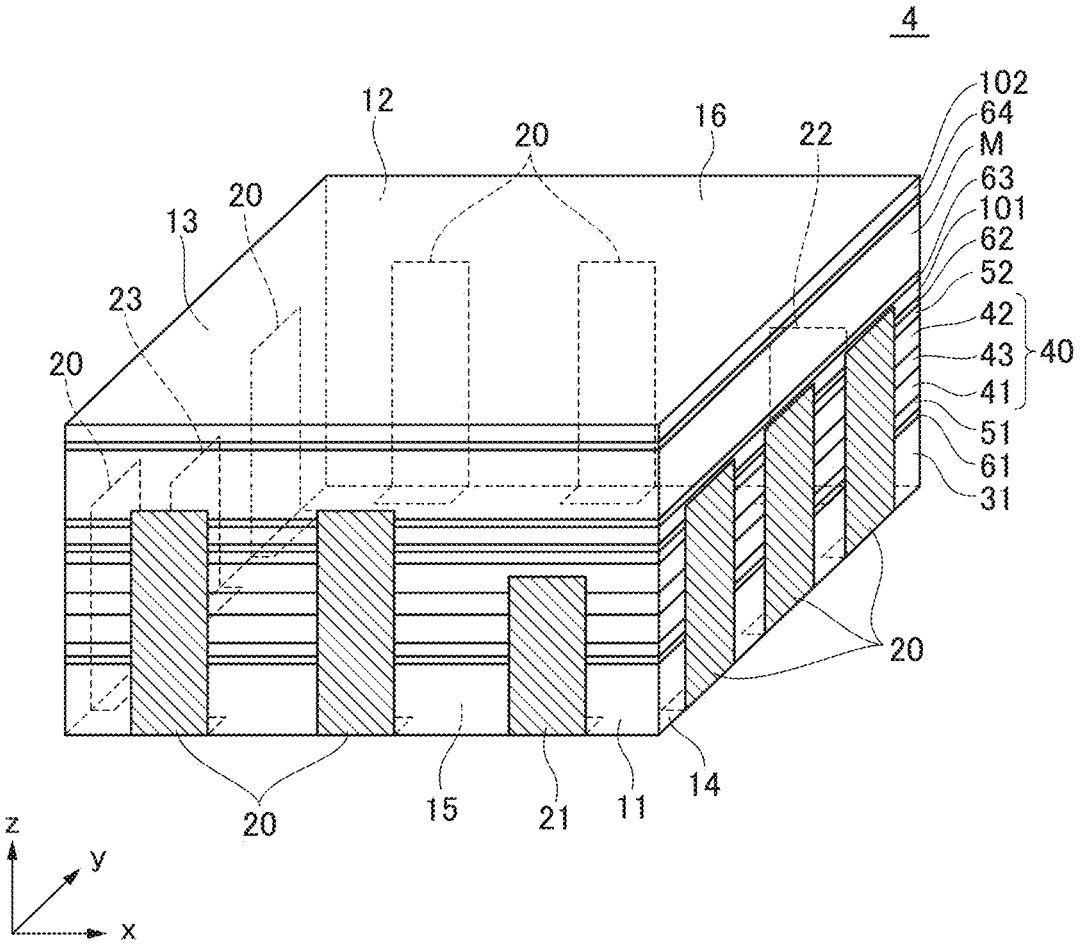
FIG. 6 is a schematic perspective view illustrating the configuration of a nonreciprocal circuit element according to a fourth embodiment of the present invention.

FIG. 6 is a schematic perspective view illustrating the configuration of a nonreciprocal circuit element 4 according to the fourth embodiment of the present invention.

As illustrated in FIG. 6, the nonreciprocal circuit element 4 according to the fourth embodiment differs from the nonreciprocal circuit element 2 according to the second embodiment in that a metal magnetic material 102 is additionally provided above the permanent magnet M. The metal magnetic material 102 and the permanent magnet M adhere to each other through a dielectric 64 having adhesiveness. Other basic configurations are the same as those of the nonreciprocal circuit element 2 according to the second embodiment, so the same reference numerals are given to the same elements, and overlapping description will be omitted.

The metal magnetic material 102 is made of, e.g., iron (Fe) and plays a role of reducing leakage magnetic flux. This makes it possible to compensate for the shortfall of the magnetic field to the ferrite core 41 whose magnetic field easily becomes weak. The thickness of the metal magnetic material 102 may be made equal to the thickness of the metal magnetic material 101.

Fifth Embodiment

Figure 7:
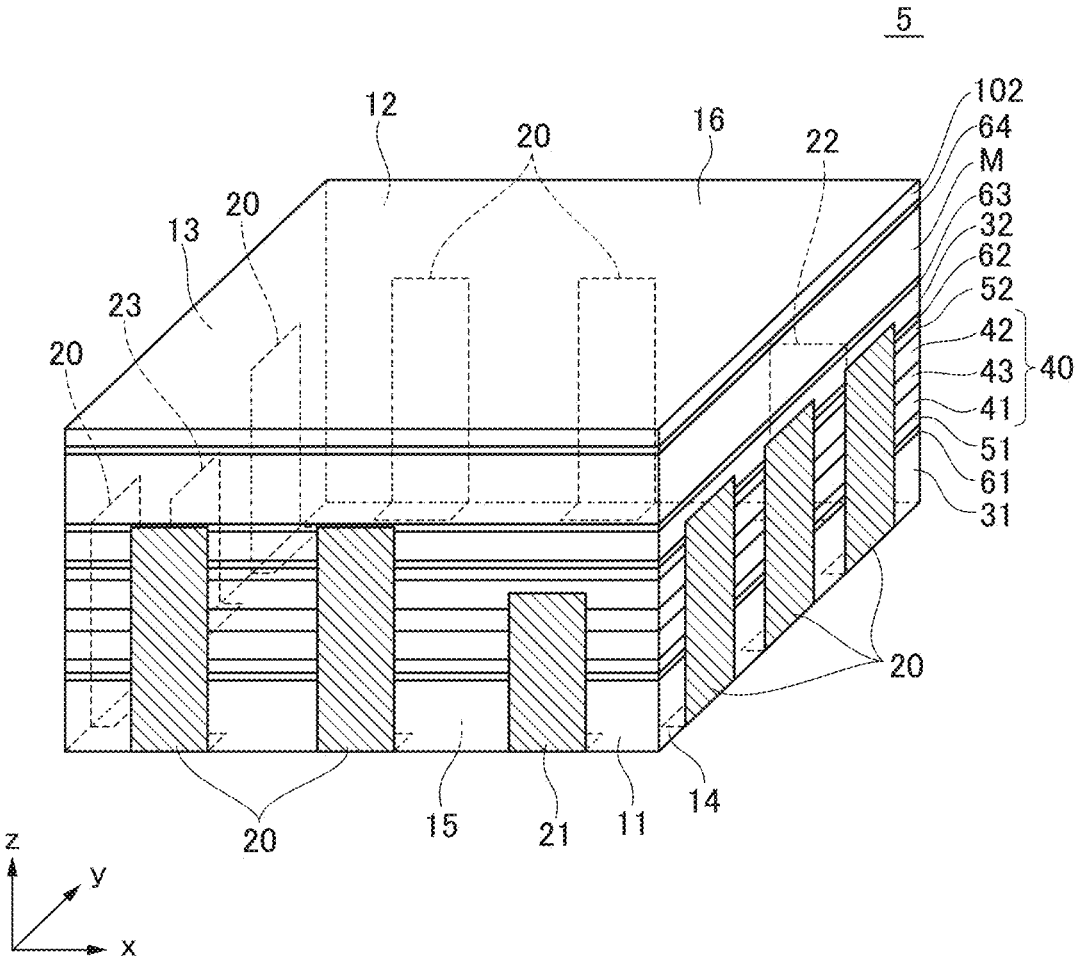
FIG. 7 is a schematic perspective view illustrating the configuration of a nonreciprocal circuit element according to a fifth embodiment of the present invention.

FIG. 7 is a schematic perspective view illustrating the configuration of a nonreciprocal circuit element 5 according to the fifth embodiment of the present invention.

As illustrated in FIG. 7, the nonreciprocal circuit element 5 according to the fifth embodiment differs from the nonreciprocal circuit element 3 according to the third embodiment in that a metal magnetic material 102 is additionally provided above the permanent magnet M. The metal magnetic material 102 and the permanent magnet M adhere to each other through a dielectric 64 having adhesiveness. Other basic configurations are the same as those of the nonreciprocal circuit element 3 according to the third embodiment, so the same reference numerals are given to the same elements, and overlapping description will be omitted.

Also in the present embodiment, addition of the metal magnetic material 102 can reduce leakage magnetic flux and can compensate for the shortfall of the magnetic field to the ferrite core 41.

Sixth Embodiment

Figure 8:
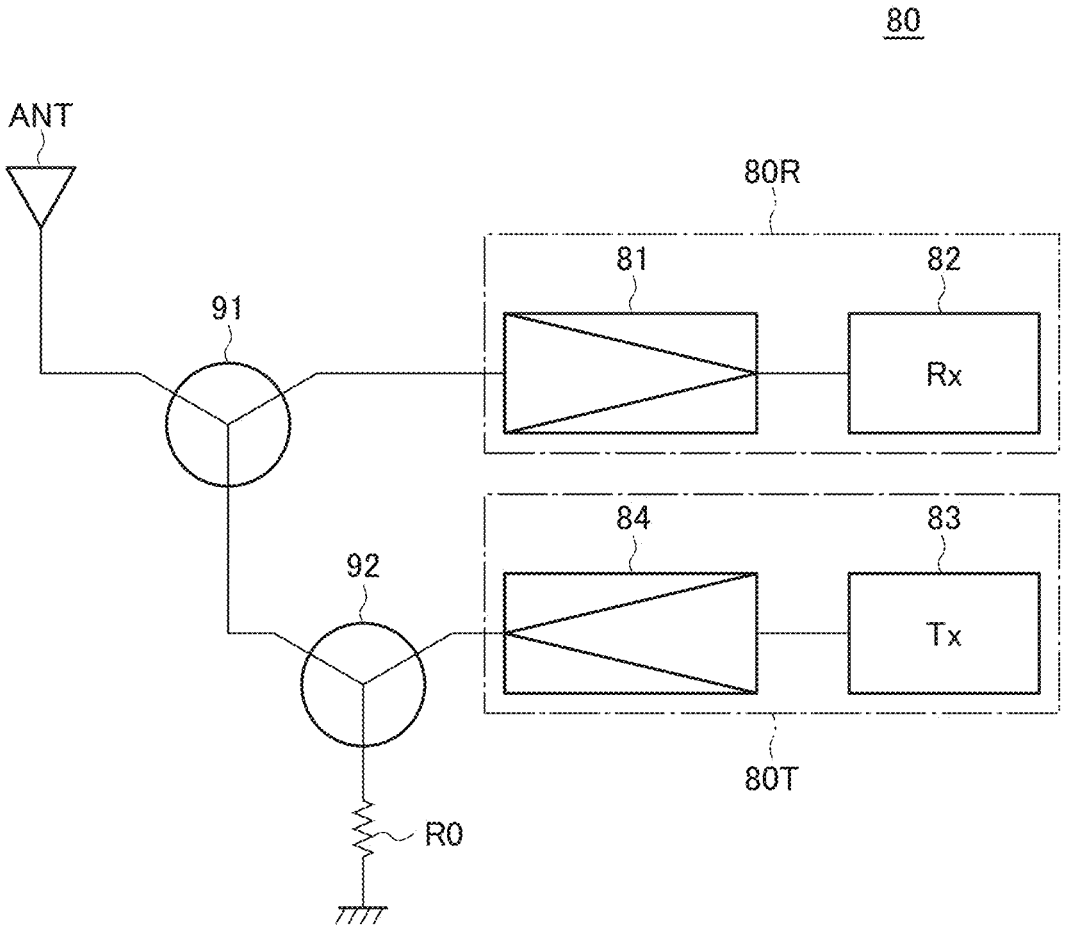
FIG. 8 is a block diagram illustrating the configuration of a communication apparatus according to a sixth embodiment of the present invention.

FIG. 8 is a block diagram illustrating the configuration of a communication apparatus 80 according to the sixth embodiment of the present invention.

The communication apparatus 80 illustrated in FIG. 8 is provided in a base station in, e.g., a mobile communication system. The communication apparatus 80 includes a receiving circuit part 80R and a transmitting circuit part 80T, which are connected to a transmitting/receiving antenna ANT. The receiving circuit part 80R includes a receiving amplifier circuit 81 and a receiving circuit 82 for processing received signals. The transmitting circuit part 80T includes a transmitting circuit 83 for generating audio signals and video signals and a power amplifier circuit 84.

In the thus configured communication apparatus 80, nonreciprocal circuit elements 91 and 92 having the same configuration as any of nonreciprocal circuit elements 1 to 5 according to the first to fifth embodiments are used in a path from the antenna ANT to the receiving circuit part 80R and a path from the transmitting circuit part 80T to the antenna ANT, respectively. The nonreciprocal circuit element 91 functions as a circulator, and the nonreciprocal circuit element 92 functions as an isolator having a terminal resistor RO.

It is apparent that the present invention is not limited to the above embodiments, but may be modified and changed without departing from the scope and spirit of the invention.

For example, in the above embodiments, the distributed-constant-type nonreciprocal circuit element is taken as an example; however, the present invention may be applied also to a lumped-constant-type nonreciprocal circuit element.

EXAMPLES

Example 1

Nonreciprocal circuit element samples 1A to 1F having the same or similar structure as the nonreciprocal circuit element illustrated in FIG. 1 were assumed, and a generated magnetic field was evaluated by simulations. All the samples had a square shape in a plan view with dimensions of 8.0 mm×8.0 mm and used YIG having a thickness of 0.8 mm as the ferrite cores 41, 42 and magnetic material 31. Further, as the permanent magnet M, a permanent magnet having a thickness of 0.8 mm was used, and the thickness of the center conductor 70 was set to 0.1 mm.

In the samples 1A, 1B, 1C, 1D, and 1E, the thicknesses of the magnetic materials 31 were set to 0 mm (magnetic material 31 was omitted), 0.4 mm, 0.8 mm, 1.6 mm, and 5.0 mm, respectively. In the sample 1F, a permanent magnet was used in place of the magnetic material 31.

Figure 9A:
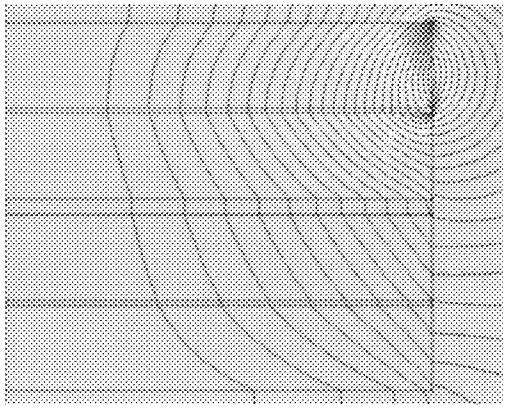
FIGS. 9A to 9F are diagrams indicating the simulation results of Example 1.
Figure 9B:
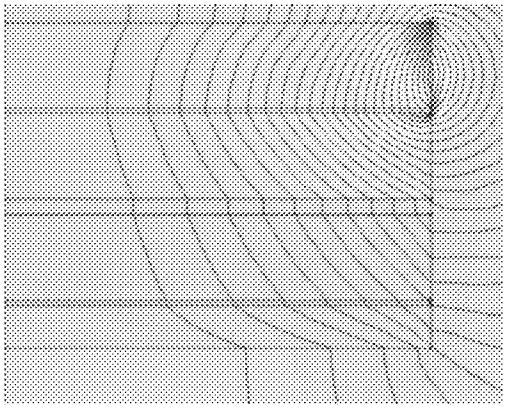
Figure 9C:
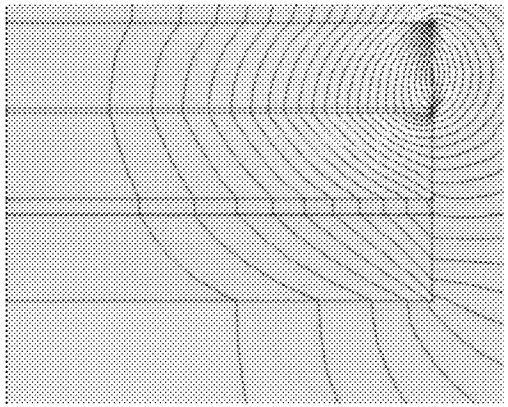
Figure 9D:
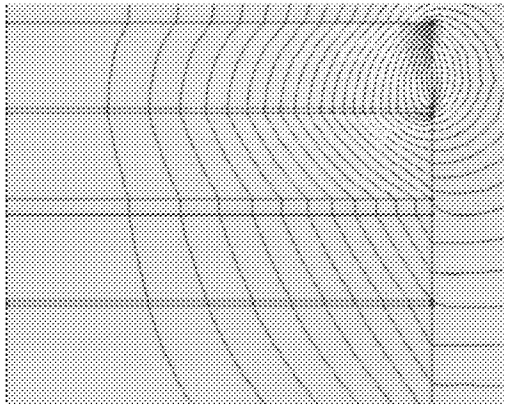
Figure 9E:
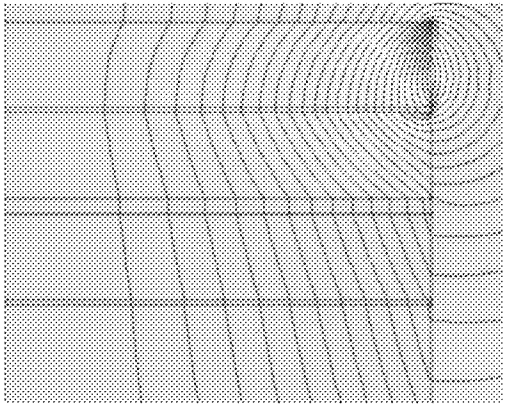
Figure 9F:
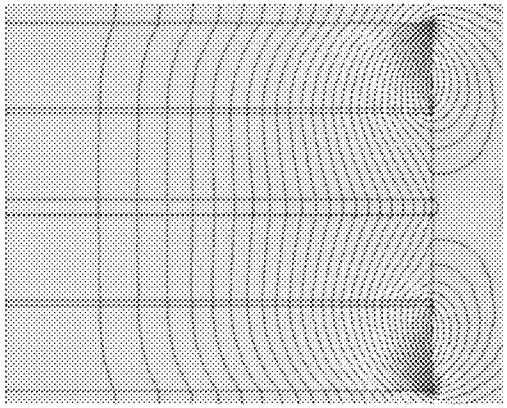

Simulation results are illustrated in FIGS. 9A to 9F. FIGS. 9A to 9F correspond respectively to the simulation results of the samples 1A to 1F. As illustrated in FIG. 9F, in the sample 1F in which two permanent magnets are disposed at the upper and lower sides, the perpendicularity of the magnetic field to be applied to the ferrite cores 41 and 42 is high, while in the samples 1A to 1E in which the lower side permanent magnet is omitted, the perpendicularity of the magnetic field to be applied to the ferrite cores 41 and 42 is deteriorated and, particularly, the strength of the magnetic field is decreased in the lower side ferrite core 41. However, by increasing the thickness of the magnetic material 31, the magnetic field perpendicularity is enhanced, and the strength of the magnetic field to be applied to the lower side ferrite core 41 is increased.

Example 2

Nonreciprocal circuit element samples 2A to 2C having the same structure as the nonreciprocal circuit element illustrated in FIG. 1 or FIG. 4 were assumed, and a generated magnetic field was evaluated by simulations. All the samples had a square shape in a plan view with dimensions of 8.0 mm×8.0 mm and used YIG having a thickness of 0.8 mm as the ferrite cores 41, 42 and magnetic material 31. Further, as the permanent magnet M, a permanent magnet having a thickness of 0.8 mm was used, and the thickness of the center conductor 70 was set to 0.1 mm.

In the samples 2A, 2B, and 2C, the thicknesses of the metal magnetic materials 101 were set to 0 mm (metal magnetic material 101 was omitted), 0.1 mm, and 0.2 mm, respectively.

Figure 10C:
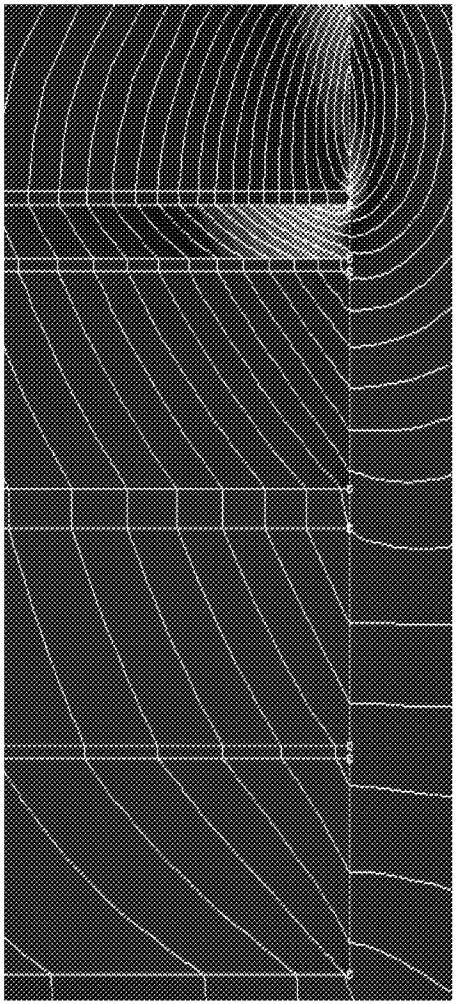
FIGS. 10A to 10C are diagrams indicating the simulation results of Example 2.
Figure 10B:
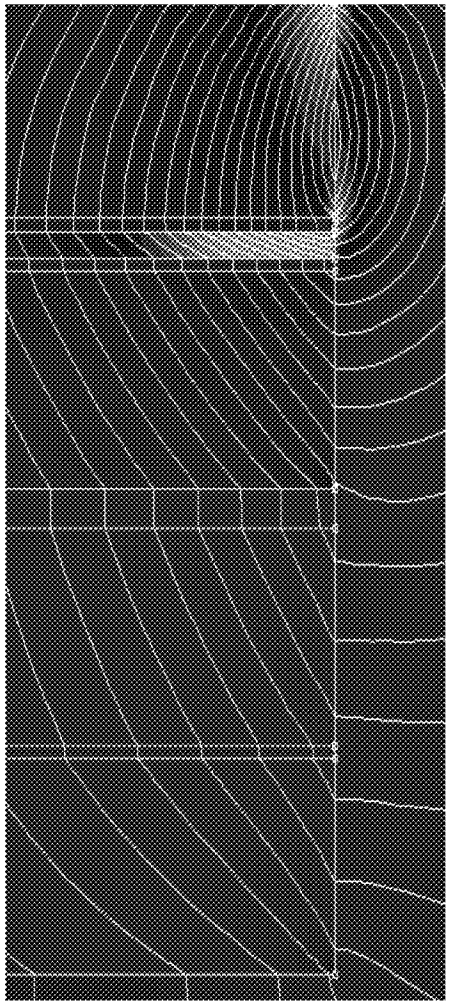
Figure 10A:
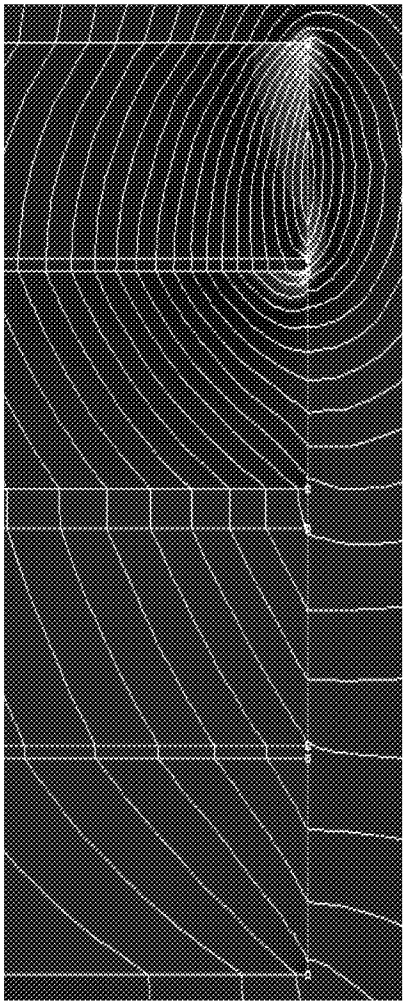

Simulation results are illustrated in FIGS. 10A to 10C. FIGS. 10A to 10C correspond respectively to the simulation results of the samples 2A to 2C. As illustrated in FIGS. 10A to 10C, the larger the thickness of the metal magnetic material 101, the more uniform the magnetic field to be applied to the upper side ferrite core 42 becomes.

Example 3

Nonreciprocal circuit element samples 3A to 3C having the same structures as the nonreciprocal circuit elements of FIGS. 1, 4, and 6, respectively, were assumed, and a generated magnetic field was evaluated by simulations. All the samples had a square shape in a plan view with dimensions of 8.0 mm×8.0 mm and used YIG having a thickness of 0.8 mm as the ferrite cores 41, 42 and magnetic material 31. Further, as the permanent magnet M, a permanent magnet having a thickness of 0.8 mm was used, and the thickness of the center conductor 70 was set to 0.1 mm.

In the samples 3B and 3C, the thickness of the metal magnetic material 101 or 102 was set to 0.1 mm.

Figure 11B:
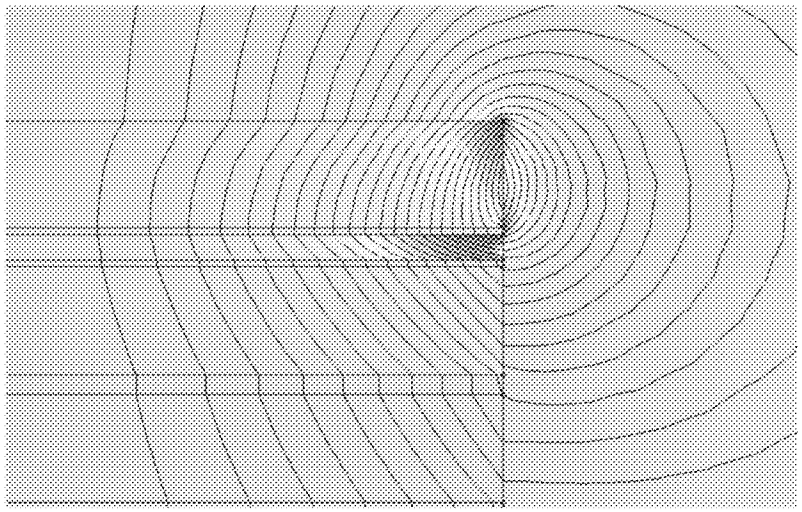
FIGS. 11A to 11C are diagrams indicating the simulation results of Example 3.
Figure 11C:
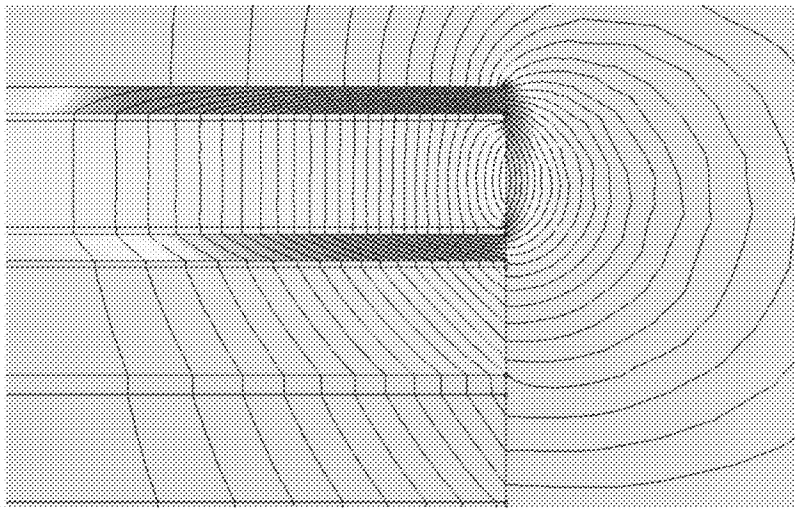
Figure 11A:
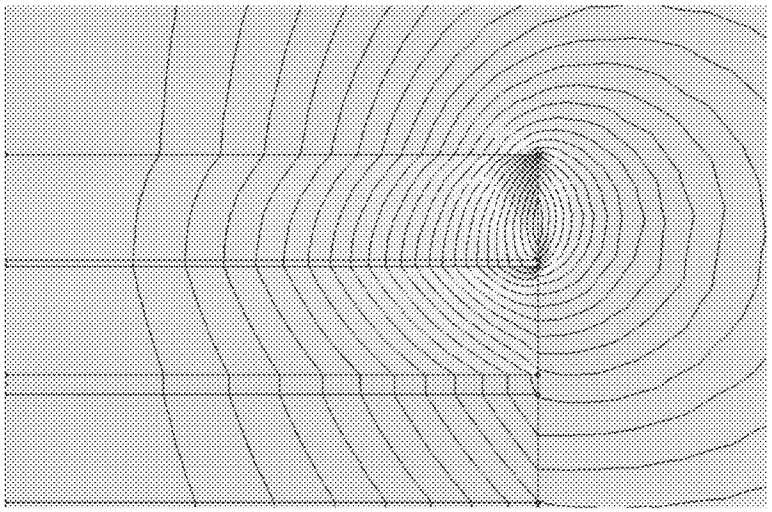

Simulation results are illustrated in FIGS. 11A to 11C. FIGS. 11A to 11C correspond respectively to the simulation results of the samples 3A to 3C. As illustrated in FIG. 11C, in the sample 3C in which the metal magnetic materials 101 and 102 are disposed above and below the permanent magnet M, the magnetic field to be applied to the lower side ferrite core 41 is slightly stronger than that in the samples 3A and 3B.

What is claimed is:

1. A nonreciprocal circuit element comprising:
- a permanent magnet;
- a magnetic material having an insulating property;
- a magnetic rotator sandwiched between the permanent magnet and the magnetic material; and
- an external terminal,
- wherein the magnetic rotator includes a center conductor connected to the external terminal, and first and second ferrite cores sandwiching the center conductor, and
- wherein the external terminal covers a side surface of the magnetic material without covering a side surface of the permanent magnet.

2. The nonreciprocal circuit element as claimed in claim 1, further comprising:
- a ground terminal; and
- a first grounding conductor which is provided between the first ferrite core and the magnetic material and connected to the ground terminal.

3. The nonreciprocal circuit element as claimed in claim 2, further comprising a second grounding conductor provided between the second ferrite core and the permanent magnet and connected to the ground terminal.

4. The nonreciprocal circuit element as claimed in claim 1, wherein a saturation magnetization of the magnetic material is equal to or smaller than a saturation magnetizations of the first and second ferrite cores.

5. The nonreciprocal circuit element as claimed in claim 4, wherein the magnetic material is made of the same material as those of the first and second ferrite cores.

6. The nonreciprocal circuit element as claimed in claim 1, further comprising a first metal magnetic material provided between the second ferrite core and the permanent magnet.

7. The nonreciprocal circuit element as claimed in claim 6, further comprising a second metal magnetic material provided on a side opposite to the first metal magnetic material with respect to the permanent magnet.

8. The nonreciprocal circuit element as claimed in claim 1, further comprising another magnetic material having an insulating property which is provided between the second ferrite core and the permanent magnet.

9. The nonreciprocal circuit element as claimed in claim 8, further comprising a metal magnetic material provided on a side opposite to the another magnetic material with respect to the permanent magnet.

10. A communication apparatus including a nonreciprocal circuit element, the nonreciprocal circuit element comprising:

a permanent magnet;

a magnetic material having an insulating property;

a magnetic rotator sandwiched between the permanent magnet and the magnetic material; and an external terminal, wherein the magnetic rotator includes a center conductor connected to the external terminal, and first and second ferrite cores sandwiching the center conductor, and wherein the external terminal covers a side surface of the magnetic material without covering a side surface of the permanent magnet.

11. A nonreciprocal circuit element comprising:

a magnetic rotator including first and second ferrite cores and a center conductor sandwiched between the first and second ferrite cores;

a soft magnetic material covering the first ferrite core;

a hard magnetic material covering the second ferrite core;

a first grounding conductor provided between the first ferrite core and the soft magnetic material; and a second grounding conductor provided between the second ferrite core and the hard magnetic material, wherein the soft magnetic material is thicker than the first ferrite core.

12. The nonreciprocal circuit element as claimed in claim 11, wherein a thickness of the soft magnetic material is more than double a thickness of the first ferrite core.

13. The nonreciprocal circuit element as claimed in claim 11, further comprising another soft magnetic material provided between the hard magnetic material and the second grounding conductor.

14. The nonreciprocal circuit element as claimed in claim 13, wherein the another soft magnetic material is made of metal material.

15. The nonreciprocal circuit element as claimed in claim 13, wherein the another soft magnetic material is made of the same material as the soft magnetic material.

16. The nonreciprocal circuit element as claimed in claim 15, wherein the another soft magnetic material is thinner than the soft magnetic material.

* * * * *